US008187053B2

(12) United States Patent
Haworth

(10) Patent No.: US 8,187,053 B2
(45) Date of Patent: May 29, 2012

(54) BREAST SUPPORT SYSTEM FOR RECUMBANT WOMAN AND METHODS OF USE

(76) Inventor: Randal Haworth, Los Angeles, CA (US)

( * ) Notice: Subject to any disclaimer, the term of this patent is extended or adjusted under 35 U.S.C. 154(b) by 0 days.

(21) Appl. No.: 12/697,340

(22) Filed: Feb. 1, 2010

(65) Prior Publication Data

US 2010/0311307 A1 Dec. 9, 2010

Related U.S. Application Data

(60) Provisional application No. 61/148,647, filed on Jan. 30, 2009.

(51) Int. Cl.
*A41C 3/00* (2006.01)

(52) U.S. Cl. ..... 450/59; 450/60

(58) Field of Classification Search ..... 450/36–39, 450/41–60, 1; 2/267, 268; 623/7, 8
See application file for complete search history.

(56) References Cited

U.S. PATENT DOCUMENTS

| | | | | |
|---|---|---|---|---|
| 2,092,390 | A | 9/1937 | Federico | |
| 2,344,237 | A | 3/1944 | Dubner | |
| 2,362,974 | A | 11/1944 | Cohen | |
| 2,406,699 | A | 8/1946 | Lustig | |
| 2,497,324 | A | 2/1950 | Schenkman | |
| 2,688,749 | A | 9/1954 | Cocks | |
| 2,697,228 | A * | 12/1954 | Orr | 450/57 |
| 2,834,352 | A * | 5/1958 | Ullian | 450/57 |
| 2,896,632 | A | 7/1959 | Tullio | |
| 2,899,961 | A | 8/1959 | Faron | |
| 2,923,301 | A | 2/1960 | Tullio | |
| 2,986,143 | A | 5/1961 | Erteszek | |
| 3,029,821 | A * | 4/1962 | Plehn | 450/55 |
| 3,054,408 | A | 9/1962 | Cousins | |
| 3,145,714 | A * | 8/1964 | Brown | 450/60 |
| 3,166,077 | A | 1/1965 | Laguzzi et al. | |
| 3,710,800 | A | 1/1973 | Carey | |
| 3,814,107 | A * | 6/1974 | Greenblatt et al. | 450/56 |
| 4,372,321 | A * | 2/1983 | Robinson | 450/39 |
| 7,044,829 | B1 * | 5/2006 | Jagaric et al. | 450/54 |
| 7,056,187 | B2 | 6/2006 | Cassity | |
| 7,549,908 | B2 | 6/2009 | Yudkoff | |
| 8,016,640 | B2 | 9/2011 | Morgan | |

* cited by examiner

*Primary Examiner* — Gloria Hale
(74) *Attorney, Agent, or Firm* — Cermak Nakajima LLP; Adam J. Cermak

(57) ABSTRACT

A breast support system for a recumbent female human includes medial and lateral support padding for each breast.

12 Claims, 3 Drawing Sheets

BREAST SUPPORT SYSTEM FOR RECUMBANT WOMAN AND METHODS OF USE

This application claims priority under 35 U.S.C. §119 to U.S. provisional application No. 61/148,647, filed 30 Jan. 2009, the entirety of which is incorporated by reference herein.

BACKGROUND

1. Field of Endeavor

The present invention relates to devices, systems, and processes useful as breast supports, and more specifically to such devices and processes useful for supporting the breasts of a recumbent female human.

2. Brief Description of the Related Art

FIG. 3 illustrates the chest and breasts of a recumbent woman and the deleterious stresses and forces generated on breast tissue and adjacent tissue, when the woman lies on her side, by gravity. The perceived problem is two-fold:

1. When the woman is sleeping on her side, the uppermost breast falls down toward the midline, and often past it. This in turn causes stresses S on the medial and lateral breast skin and the underlying ligaments.

2. When a woman is lying on her back, both breasts fall laterally (to the sides) and often times into the axillae (armpits).

Eventually, these stresses on the breast tissues promote stretching of the skin and resultant breast ptosis (drooping), widening of the breast, and vertically oriented breastbone skin creases C (over the woman's sternum). Additionally, the lower, inferior-most breast sustains laterally compressive and compacting forces F, which can lead to folding of the breast skin upon itself.

SUMMARY

According to a first aspect of the invention, a breast support system for a recumbent woman comprises a left medial padding and a right medial padding, the medial paddings being joined together, a left lateral padding and a right lateral padding, wherein the left medial padding is positioned adjacent to the left lateral padding and forms a V-shape therewith configured and arranged to support a left breast of said recumbent woman, wherein the right medial padding is positioned adjacent to the right lateral padding and forms a V-shape therewith configured and arranged to support a right breast of said recumbent woman, and a strap system attached to both V-shapes, the strap system configured and arranged to extend over the shoulders of said recumbent woman.

According to another aspect of the present invention, a method of inhibiting ptosis and widening of the breasts of a woman, the method comprises providing a medial padding and a lateral padding for each breast, each pair of medial and lateral paddings forming a V-shape, and a strap system attached to both V-shapes, the strap system configured and arranged to extend over the shoulders of said woman, and supporting lateral and medial portions of each breast of the woman when recumbent.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
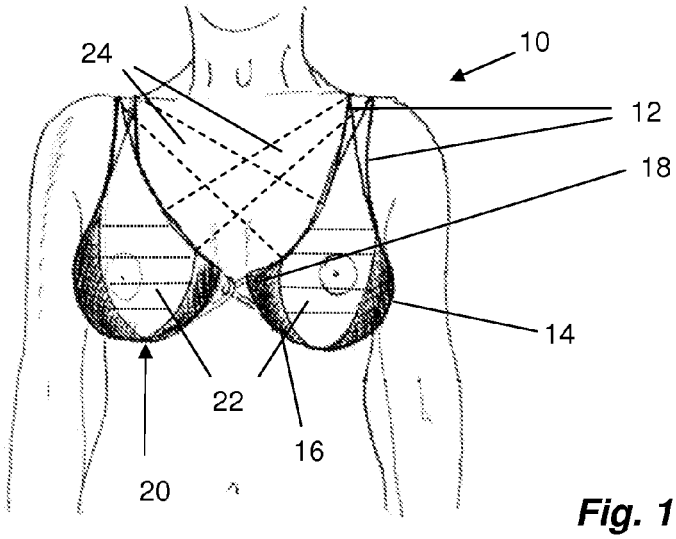
FIG. 1 illustrates a woman wearing an exemplary device embodying principles of the present invention.

Referring to the drawing figures, like reference numerals designate identical or corresponding elements throughout the several figures.

With reference to FIG. 1, an exemplary support system 10 is illustrated. The system includes at least one (preferably a pair) shoulder strap system 12, which are connected together on a back portion of the system (not illustrated) in a manner typical of brassieres. Each strap system 12 is connected to a lateral padding support 14 and to a medial padding support 16, for each breast, which can be crescent-shaped. When such paddings 14, 16 are provided in a pair, one set for each breast, they are advantageously attached together, such as via a clasp 18 or a more permanent connection. According to one exemplary embodiment, the lateral 14 and medial 16 padding supports together form a V-shape, including an open space 22 between the two padding supports. According to other exemplary embodiments, the open space 22 can be bridged by fabric or the like, described elsewhere herein.

The lateral padding support 14 and medial padding support 16 are joined together at a smaller lower support section 20; as indicated in FIG. 1, the lower support section 20, which is generally opposite the strap system 12, can be significantly smaller and provide less support than the padding supports 14, 16, because it is less necessary to generate support from the bottom portions of the breast when the woman is recumbent. Optionally, the padding supports 14, 16 can be additionally joined together directly between them, such as by the further inclusion of fabrics or the like (suggested by the dotted lines in FIG. 1), in order to provide additional medial and lateral support for the recumbent woman's breast, and form a cup. Further optionally, if additional medial and lateral support is desired for the recumbent woman's breasts, the strap systems 12 can further include cross-supports 24, indicated generally by the dotted lines connecting the top portion of the left strap system 12 to the right padding supports 14, 16, and the dotted lines connecting the top portion of the right strap system 12 to the left padding supports 14, 16. The cross-supports 24 can provide additional support for the inferior-most breast by providing a support which is more directly opposed to that of gravity, when the woman is recumbent.

Figure 3:
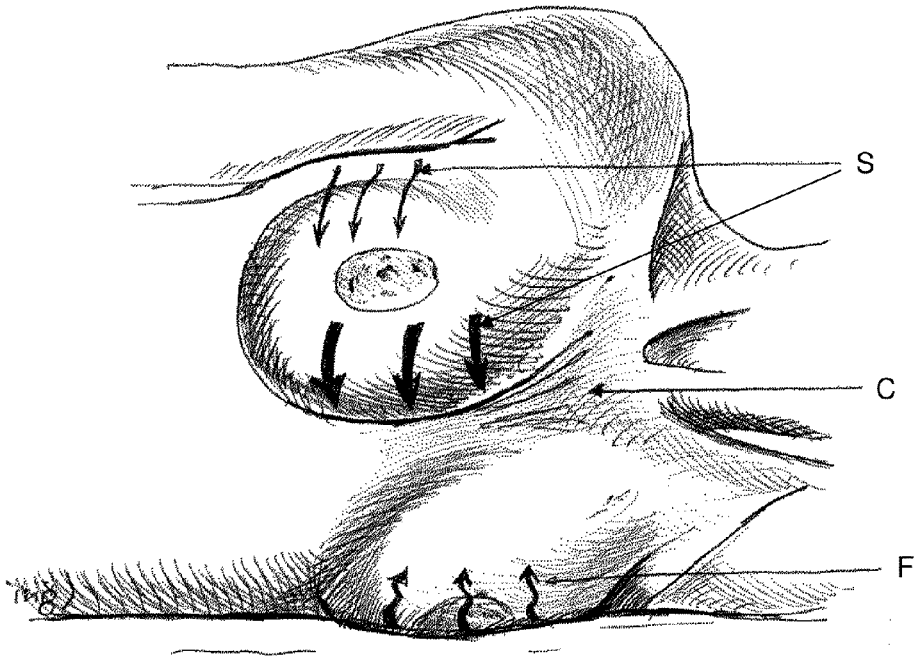
FIG. 3 illustrates the breasts of a recumbent women and the deleterious stresses and forces generated on breast tissue and adjacent tissue, when the woman lies on her side.
Figure 4:
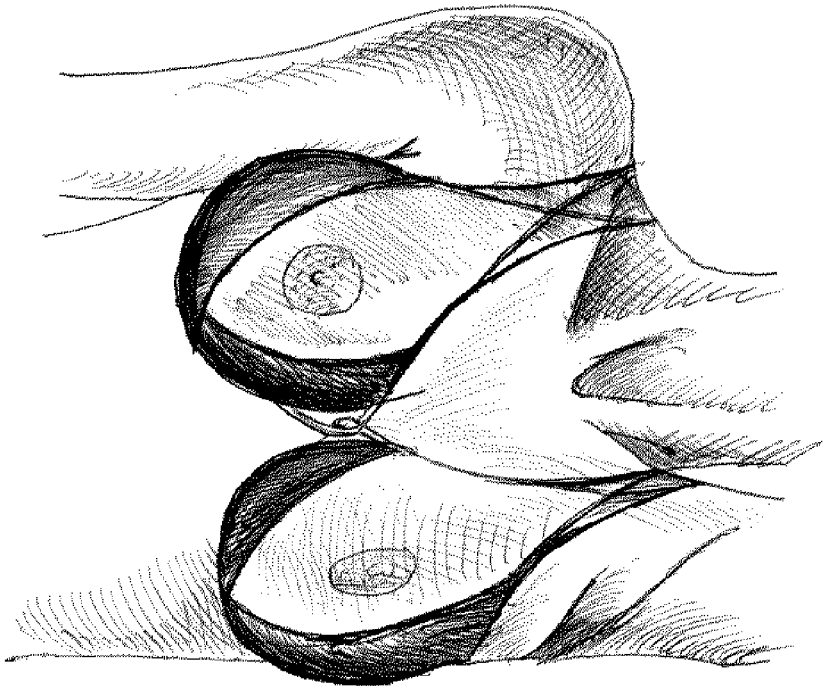
FIG. 4 illustrates a view similar to that of FIG. 3, with an exemplary device of the present invention supporting the breasts.

These unique positions of the paddings 14, 16 differentiate a support system 10 of the present invention from prior support bras. The support system 10 and the pads thereof are designed and positioned to withstand and counteract the forces exerted upon the breast in the recumbent position, especially when a woman is sleeping on her sides as illustrated in FIGS. 3 and 4, while prior support bras include significant vertical support sections, while providing little or no augmented medial and lateral support.

Figure 2:
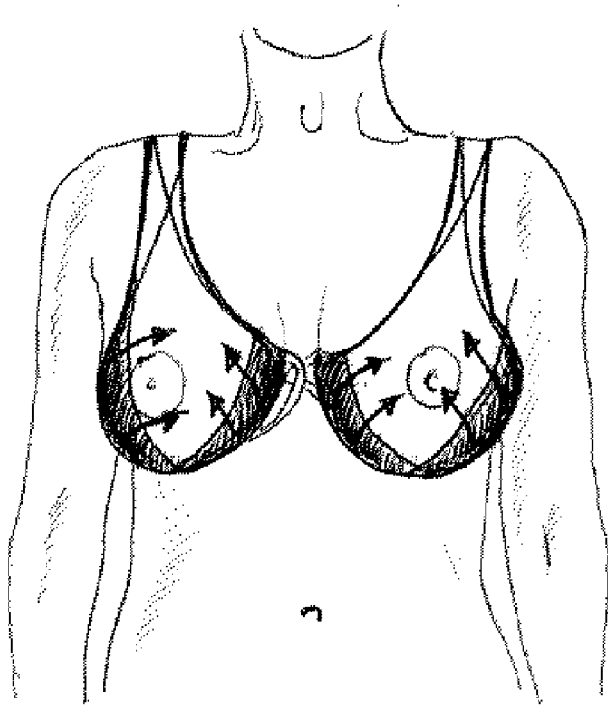
FIG. 2 illustrates a view similar to that of FIG. 1, showing lines of force generated by the exemplary device.

FIG. 2 illustrates the directions of the forces generated by the support 10, which are caused by the positioning of the lateral and medial pads relative to the breast and to the shoulder straps. The support 10 of the present invention generates forces which oppose and counteract the gravity forces on the breasts, in particular the skin and Cooper's ligaments, when the woman is in a recumbent position.

The paddings 14, 16, can be formed of any suitable material, but are advantageously constructed to be sufficiently rigid to transmit the forces necessary to provide the medial and lateral support described herein, yet are preferably contoured and soft enough to be comfortably worn. The system 10 is preferably, although not necessarily, constructed of natural and/or synthetic fabrics, in manners well know to those of skill in the art, and further includes clasps and adjustment mechanism commonly incorporated in brassieres.

Figure 5:
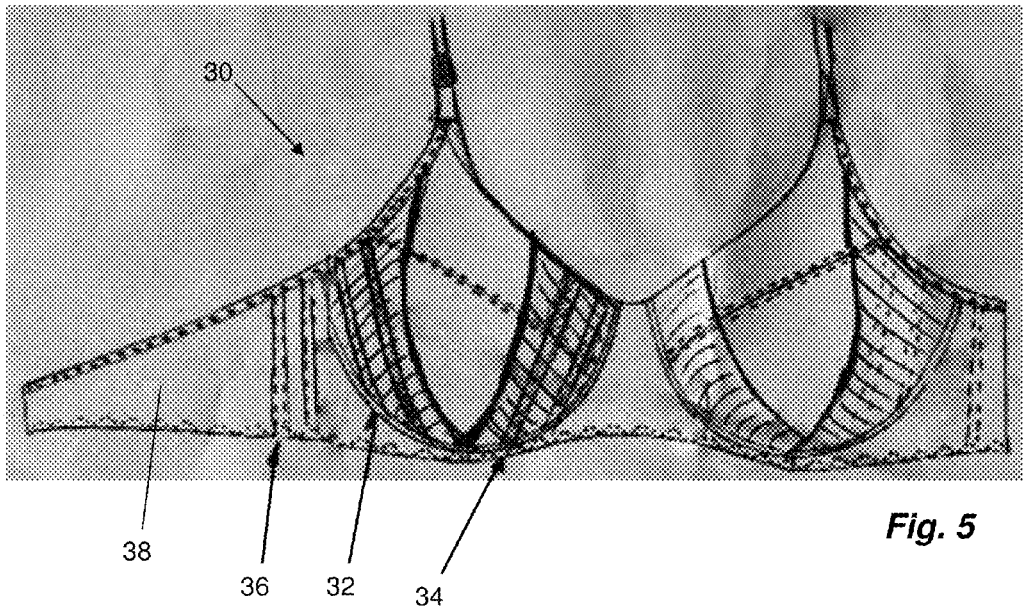
FIG. 5 illustrates a front elevational view of another device embodying principles of the present invention.

FIG. 5 illustrates yet another support 30 embodying principles of the present invention, which is similar in many respects to the embodiment illustrated in FIGS. 1 and 2. The support 30 includes, in addition to the features described with reference to support 10, one or more ribs or vertical rigid supports 32, 34 extending along or through at least one of the left medial padding, the right medial padding, the left lateral padding, and the right lateral padding. Advantageously, the vertical supports 32, 34 generally extend along the length of the padding, e.g. generally from the vertex of the 'V' formed by each pair of medial and lateral paddings. Optionally, horizontal ribs (not illustrated) can be provided in the paddings instead of or in addition to the vertical supports 32, 34. Vertical rigid supports 36 can also optionally be provided in the band 38. The vertical supports 32, 34, 36 provide additional support by causing the padding(s) to be more rigid. Alternatively, the vertical supports 32, 34, 36 can be further augmented by, or replaced by, a thickened pad or the like in the padding. Further optionally, the padding(s) can include magnets or other such devices which can have a therapeutic effect on the breast tissue.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents.

I claim:

1. A breast support system for a recumbent woman comprising:

a left medial padding support and a right medial padding support, the medial padding supports being crescent-shaped and joined together;

a crescent-shaped left lateral padding support and a crescent-shaped right lateral padding support;

wherein the left medial padding support is positioned adjacent to the left lateral padding support and forms a V-shaped cup therewith configured and arranged to support a left breast of said recumbent woman with the left medial padding support supporting medial portions of the left breast from moving medially and the left lateral support supporting lateral portions of the left breast from moving laterally;

wherein the right medial padding support is positioned adjacent to the right lateral padding support and forms a V-shaped cup therewith configured and arranged to support a right breast of said recumbent woman with the right medial padding support supporting medial portions of the right breast from moving medially and the right lateral padding support supporting lateral portions of the right breast from moving laterally; and a strap system attached to both V-shapes, the strap system configured and arranged to extend over the shoulders of said recumbent woman.

2. The breast support system according to claim 1, wherein the strap system is also configured and arranged to transmit forces from said recumbent woman's left breast to said recumbent woman's right shoulder when said recumbent woman is lying on her left side or her back.

3. The breast support system according to claim 1, wherein the strap system is also configured and arranged to transmit forces from said recumbent woman's right breast to said recumbent woman's left shoulder when said recumbent woman is lying on her right side or her back.

4. The breast support system according to claim 1, wherein the medial and lateral padding supports each include top and bottom portions, and wherein the strap system is attached to top portions of the medial and lateral padding supports.

5. The breast support system according to claim 1, wherein the medial and lateral padding supports each include top and bottom portions, and wherein the left medial padding support bottom portion is connected to the left lateral padding support bottom portion, and wherein the right medial padding support bottom portion is connected to the right lateral padding support bottom portion.

6. The breast support system according to claim 1, wherein the medial and lateral padding supports each include top and bottom portions, and wherein the strap system further comprises:

a right strap attached to the right medial and right lateral padding support top portions;

a left strap attached to the left medial and left lateral padding support top portions.

7. The breast support system according to claim 6, wherein the strap system further comprises:

a left-to-right cross-strap attached between the left strap and the right medial and right lateral padding support top portions, the left-to-right cross-strap being configured and arranged to transmit forces from said recumbent woman's right breast to said recumbent woman's left shoulder when said recumbent woman is lying on her right side or her back.

8. The breast support system according to claim 6, wherein the strap system further comprises:

a right-to-left cross-strap attached between the right strap and the left medial and left lateral padding support top portions, the right-to-left cross-strap being configured and arranged to transmit forces from said recumbent woman's left breast to said recumbent woman's right shoulder when said recumbent woman is lying on her left side or her back.

9. The breast support system according to claim 1, further comprising:

vertical rigid supports extending through at least one of the left medial padding support, the right medial padding support, the left lateral padding support, and the right lateral padding support.

10. A method of inhibiting psosis and widening of the breasts of a woman, the method comprising:

providing a crescent-shaped medial padding support and a crescent-shaped lateral padding support for each breast, each pair of medial and lateral padding supports forming a V-shaped cup, both V-shaped cups being connected together, and a brassiere strap system attached to both cups, the strap system configured and arranged to extend over the shoulders of said woman; and supporting lateral and medial portions of each breast of the woman when recumbent such that the left medial padding support supports medial portions of the left breast from moving medially and the left lateral padding support supports lateral portions of the left breast from moving laterally, and the right medial padding support supports medial portions of the right breast from moving medially and the right lateral padding support supports lateral portions of the right breast from moving laterally.

11. A method of inhibiting ptosis and widening of the breasts of a woman, the method comprising:

providing a breast support system according to claim 1; and supporting lateral and medial portions of each breast of the woman when recumbent such that the left medial padding support supports medial portions of the left breast from moving medially and the left lateral padding support supports lateral portions of the left breast from moving laterally, and the right medial padding support supports medial portions of the right breast from moving medially and the right lateral padding support supports lateral portions of the right breast from moving laterally.

12. The breast support system according to claim 1, wherein the medial and lateral padding supports each include top and bottom portions, and wherein the strap system further comprises:

a first right strap attached to the right lateral padding support top portion;

a second right strap attached to the left medial padding support top portion;

a first left strap attached to the left lateral padding support top portion; and a second left strap attached to the right medial padding support top portion.

* * * * *